United States Patent [19]

Whipple et al.

[11] Patent Number: 4,591,517

[45] Date of Patent: May 27, 1986

[54] WEB DRYER WITH VARIABLE VENTILATION RATE

[75] Inventors: Rodger E. Whipple, Neenah, Wis.; Richard H. Curtis, Gorham, Me.

[73] Assignee: Overly, Inc., Neenah, Wis.

[21] Appl. No.: 618,585

[22] Filed: Jun. 8, 1984

[51] Int. Cl.[4] ..... B05D 3/04

[52] U.S. Cl. ..... 427/378; 118/68; 118/665; 118/688; 432/72; 432/59; 432/8

[58] Field of Search ..... 432/72, 59, 8; 8/54, 8/48, 242; 118/665, 688, 68; 427/378

[56] References Cited

U.S. PATENT DOCUMENTS

| | | | |
|---|---|---|---|
| 2,743,529 | 5/1956 | Hayes | 34/35 |
| 3,521,600 | 7/1970 | Toya | 118/665 |
| 3,596,071 | 7/1971 | Doering | 118/664 X |
| 3,874,091 | 4/1975 | Fukumoto | 34/66 |
| 3,909,953 | 10/1975 | Hemsath et al. | 34/26 |
| 4,087,568 | 5/1978 | Fay et al. | 34/54 X |
| 4,414,757 | 11/1983 | Whipple | 34/155 |
| 4,494,315 | 1/1985 | Roos et al. | 34/54 X |

*Primary Examiner*—Shrive P. Beck

[57] ABSTRACT

A web dryer for use in the graphic arts industry or the like includes a dryer housing through which a printed web travels and which contains a plurality of nozzles, an air inlet, an air exhaust and a source of heat. The desired ventilation rate for purposes of maintaining the interior dryer environment at a required low percentage of the Lower Flammable Limit is designed to be dependent on the measured or calculated rate of ink application to the web. The ink application rate and information regarding the actual exhaust flow or ventilation rate is fed to a ventilation rate control and the exhaust flow or ventilation rate is then varied in response thereto, as by controlling a variable speed exhaust blower. At the same time, make-up air is provided to the dryer interior, preferably at a point remote from the exhaust discharge duct so that it thoroughly mixes with recirculating air within the dryer to reduce condensation problems. The make-up air can be supplied from a number of sources, as illustrated in the various embodiments disclosed.

54 Claims, 10 Drawing Figures

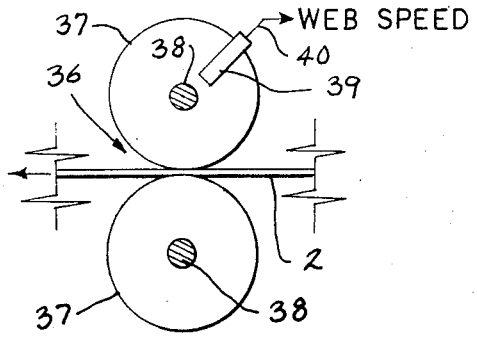
FIG. 5
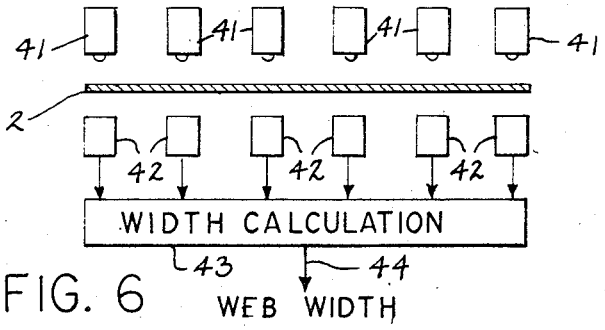
FIG. 6
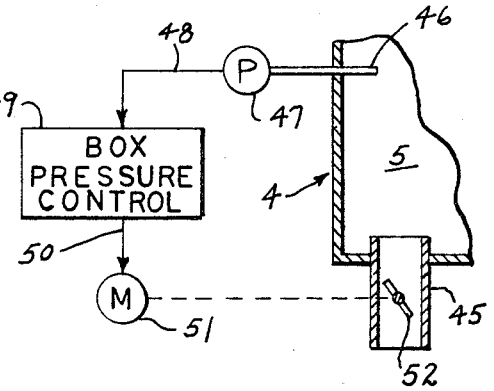
FIG. 7A
FIG. 7B
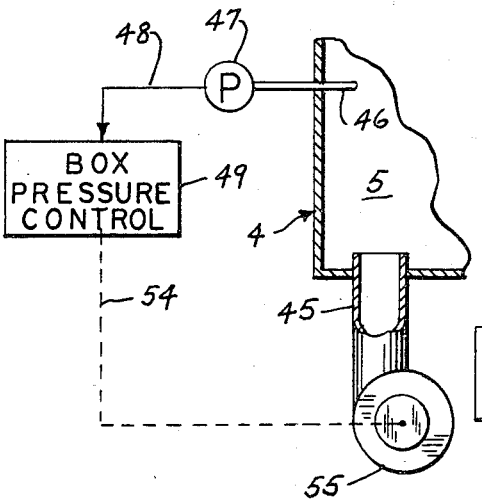
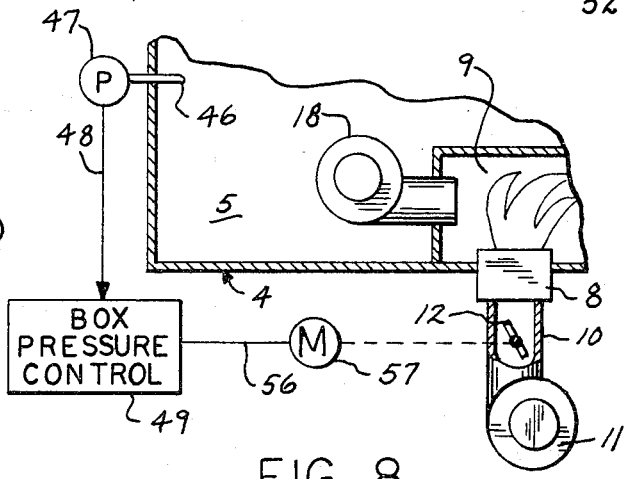
FIG. 8
FIG. 9
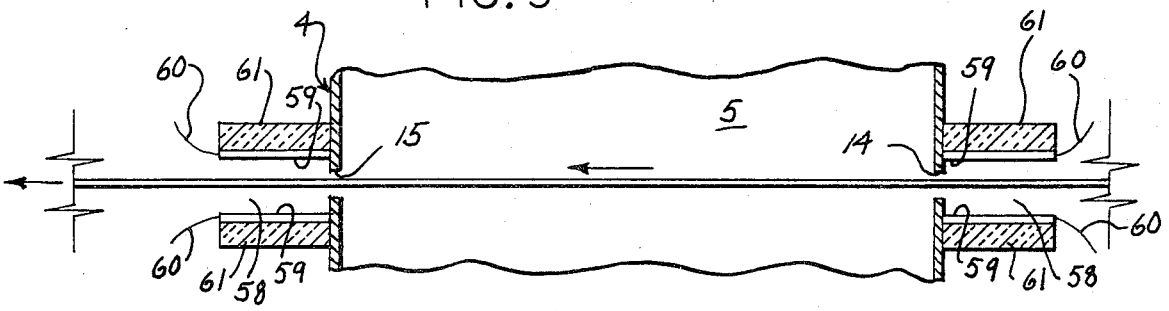

WEB DRYER WITH VARIABLE VENTILATION RATE

U.S. PRIOR ART OF INTEREST

| U.S. Pat. No. | Inventor | Issue Date |
|---|---|---|
| 2,743,529 | Hayes | May 1, 1956 |
| 3,909,953 | Hemsath et al | October 7, 1975 |
| 4,414,757 | Whipple | November 15, 1983 |

BACKGROUND AND SUMMARY OF THE INVENTION

This invention relates to a web dryer with a variable ventilation rate, and more particularly to web dryers which are used in the application of solvent based coatings such as printing ink to webs of paper and the like, such as in the graphic arts industry.

A web dryer of the general type under consideration here is illustrated in the above-identified Whipple U.S. Pat. No. 4,414,757 which includes a dryer housing through which a web travels and which contains a plurality of web dryer nozzles, an air inlet, an air exhaust and a source of heat. The nozzles are often generally of the Coanda type, described more fully in said Whipple patent.

Of major importance in using such dryers in the graphic arts industry is the requirement of evaporating the solvents from the coatings disposed on the paper web. However, such solvents are often flammable and it is essential that a certain ventilation rate be maintained in the dryer so that the solvent concentration does not increase to the explosive or flammable point. This point is the leanest mixture of solvent and air which would cause an explosion, and is referred to in the industry as the "Lower Flammable Limit" or LFL.

Under the guidelines of the National Fire Protection Association (NFPA), and with only several minor exceptions, the vapors in a working dryer must be no higher than 25% of the said Lower Flammable Limit, and the industry, during the normal course of operation most often finds themselves operating at less than 10% of the LFL.

A number of problems have arisen in attempting to maintain the vapor levels at or near 25% of the Lower Flammable Limit. The usual procedure has been to provide an air ventilation rate which is based on the ink application machine operating at maximum design conditions. However, this is an inefficient procedure when operating at less than the maximum conditions, i.e. 25% of the LFL, in that fuel is used to heat unrequired quantities of ventilation air. Previous attempts to reduce or vary the ventilation rate have not been fully successful for a variety of reasons. It must be borne in mind that when operating at or near 25% of the LFL, undesirable solvent condensation may occur more easily on the surfaces within the dryer and may interfere with the web drying function.

Some prior systems have attempted to measure the "solvent humidity" in the dryer air at the exhaust duct and then vary the ventilation rate accordingly. See U.S. Pat. No. 2,743,529. These systems are believed to be unstable and the equipment has often required recalibration. Other prior systems have attempted to measure the oxygen content within the dryer atmosphere and then vary the ventilation rate, but a failure of such devices could lead to a catastrophic explosion. See also U.S. Pat. No. 3,909,953 wherein a damper is used to control the air supply or exhaust for the purpose of keeping the oxygen level low.

It is a task of the present invention to provide a unique system for varying the ventilation rate of a web dryer which will not be subject to the various disadvantages of the known dryers and which will substantially reduce the energy consumption thereof under many operating conditions, while also reducing the problem of solvent condensation within the dryer. It is a further task of the invention to provide a low degree of operator attention needed, consistent with the important requirements of safety and reliability. It is yet another task to provide a system which, while relatively sophisticated, can be retrofit to prior driers in the field.

In considering the invention it should be kept in mind that the dryer "box" or housing is normally maintained at a generally constant slightly negative pressure. The mass of air being exhausted is equal to the mass of air being supplied. The ventilation rate is, in effect, equal to the exhaust rate, which provides a measure thereof, so it is important to measure the latter for purposes of controlling the system. Air normally enters a dryer in a number of ways, the most obvious being: (a) through the narrow slots in the dryer wall through which the web passes, where air infiltrates, and (b) the heating (combustion) air inlet for drying. However, the mass of air infiltrating through the said web slots is normally not controllable, whereas the mass of said combustion air is. Furthermore, most air dryers of the type under consideration here are provided with a recirculating air system for purposes of maintaining the air temperature as constant as possible within the dryer itself.

In accordance with the various aspects of the invention, a special computation is made as to what the ventilation rate through the dryer should be, depending on certain conditions, and the ventilation rate automatically varied in accordance with the said conditions. This desired ventilation rate is equivalent to the rate of exhaust discharge.

In order to properly control the ventilation rate, it is necessary to know the mass of ink or other solvent based coating entering the dryer per unit of time, such as lbs./hr. This is dependent on the rate of ink application to the web at the printing press or other application device, either measured or calculated.

The measured ink application rate may be determined by sensing the total amount of ink flowing from one or more ink sources to the ink application device such as a printing press.

The calculated ink application rate may be determined by sensing the number of flowing ink supplies feeding onto the web at the printing press and calculating the amount of flowing ink supplied as if the ink was applied at a maximum amount (consistent with industry standards), such as in lb/sq. in. However, such sensing and calculating doesn't directly indicate the area (mass) of ink put down on the traveling web without taking additional conditions into account. In order to obtain the area measurement, it is therefore necessary to also measure the width of the web and the speed of web movement through the dryer.

The various aspects of the invention contemplate determining the ink application rate as per one of the above methods, feeding information regarding the actual exhaust flow (ventilation rate) and these determinations to a ventilation rate control, and then varying the exhaust flow in response thereto to maintain the desired ventilation rate through the dryer, as by controlling a variable speed exhaust blower.

In actuality, the ventilation rate includes the incoming combustion air and the infiltration of air through the web slots or other small openings. The difference between the ventilation rate and the other items mentioned must be provided by make-up air. Therefore, at the same time, make-up air is provided to the dryer interior, preferably at a point remote from the exhaust discharge duct so that it mixes with the recirculating air to keep the solvent vapor concentration inside the dryer uniform and to reduce potential solvent condensation problems.

The make-up air can be supplied from a number of sources. In embodiments where the amount of air infiltration at the web slots is reduced, an open make-up air opening may be disposed in the dryer housing wall. Alternately, a control loop responsive to internal dryer box pressure may control a valve or a variable speed blower associated with an open or blower fed make-up opening. Another alternative control loop arrangement feeds the make-up air in through a valved input to the combustion burner which heats the dryer air. Either control loop alternate performs the same function. They both maintain box pressure and thereby maintain reduced infiltration at the web slots, despite variations in exhaust flow or burner air flow. In a further embodiment, where control of the amount of air infiltration at the web slots is not contemplated, air entering the web slots is preheated and performs the make-up function.

BRIEF DESCRIPTION OF THE DRAWINGS

The accompanying drawings illustrate the best mode presently contemplated by the inventors for carrying out the invention.

In the drawings:

FIG. 5 is a schematic representation of measuring the web speed;

FIG. 6 is a schematic representation of measuring the web width taken on line 6—6 of FIG. 2;

FIG. 7A is a schematic showing of a further embodiment of make-up air supply;

FIG. 7B is a schematic showing of an additional embodiment of make-up air supply;

FIG. 8 is a schematic showing of another embodiment of make-up air supply; and FIG. 9 is a schematic showing of yet another embodiment of make-up air supply.

DESCRIPTION OF THE PREFERRED EMBODIMENTS

Figure 1:
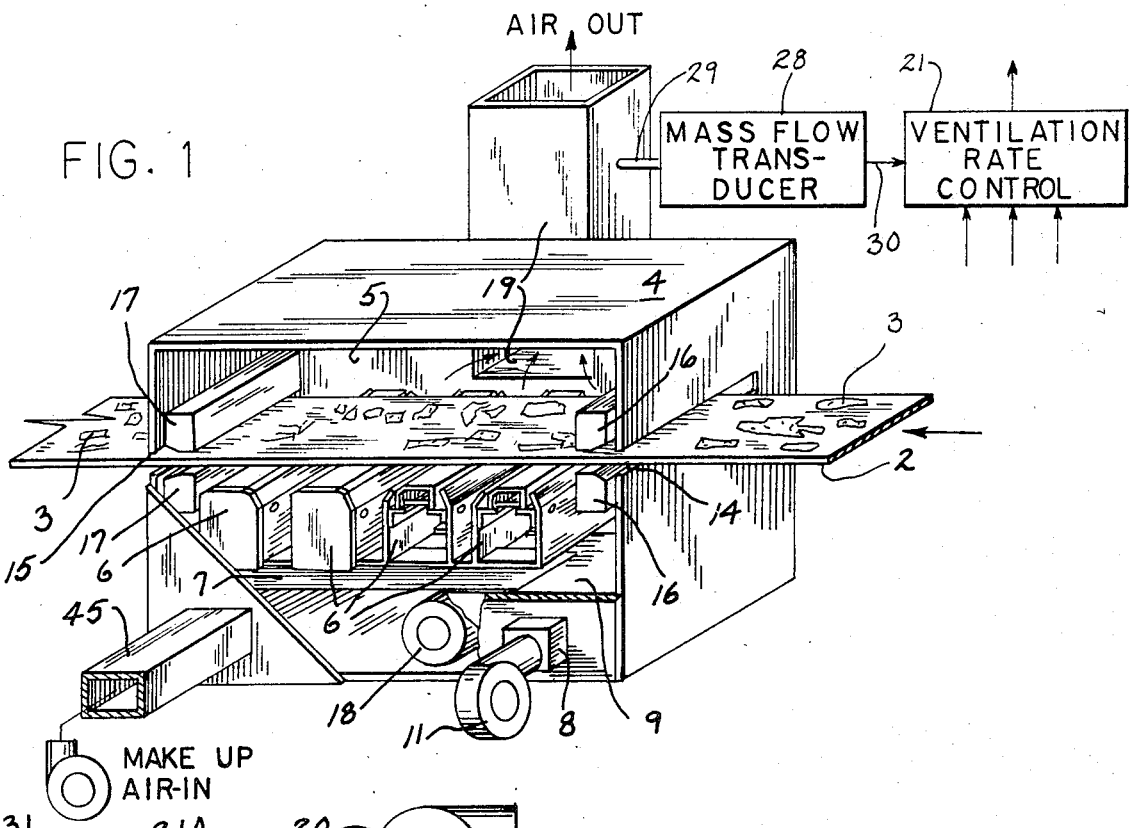
FIG. 1 is a perspective view with parts broken away showing a web passing through a web dryer which incorporates various aspects of the invention.
Figure 2:
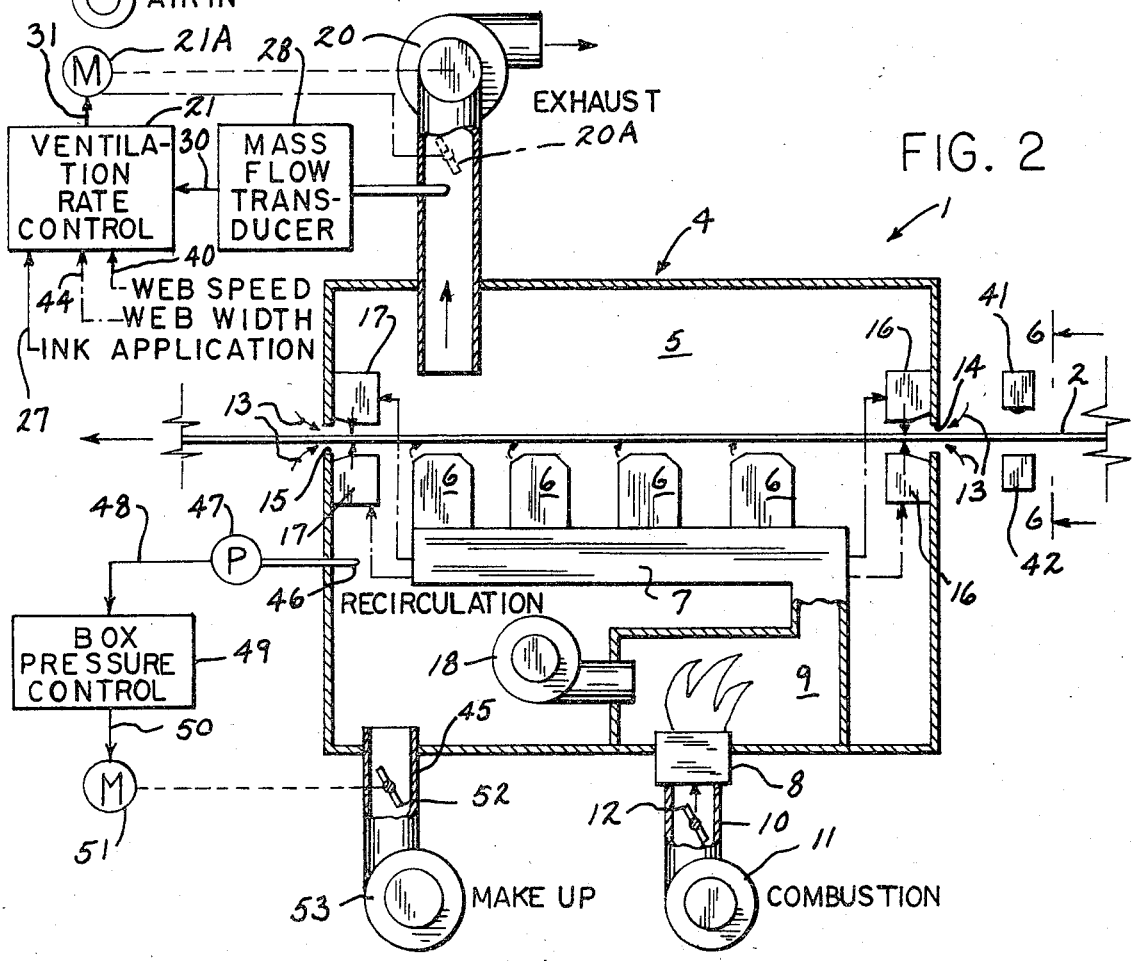
FIG. 2 is a schematic showing of the dryer illustrating one embodiment of make-up air supply.

As best shown in FIGS. 1 and 2, a web dryer 1 is positioned for passthrough thereof of a fast moving flexible continuous web 2 of paper or the like which has been printed with ink 3 from a printing press (not shown) as is common in the graphic arts industry. Dryer 1 comprises a generally enclosed housing 4 forming a web and ink drying chamber 5 having a plurality of spaced parallel nozzle assemblies 6 extending transversely to the direction of web movement. Assemblies 6 may be of any suitable well-known type such as the Coanda-type assemblies illustrated in U.S. Pat. No. 4,414,757. Heated air is continuously supplied under pressure and through a manifold 7 to the various assemblies 6, with the air then passing from the assembly nozzles into the area of the moving web for drying purposes, as shown by the arrows in FIG. 2. Although nozzle assemblies 6 are shown as being disposed only on one side of web 2, they may be disposed on both sides if desired.

The heated drying air is supplied to manifold 7 from any suitable source of combustion. As shown in FIGS. 1 and 2, a fuel fed burner 8 is disposed in a plenum 9 in dryer chamber 5, with plenum 9 being connected to manifold 7. A heating duct 10 extends outwardly from burner 8 and its outer end has mounted thereon a constant speed blower 11 to selectively supply inlet air to the burner. A butterfly valve 12 is shown in FIG. 2 as disposed in duct 10 to control the air input, and may be suitably controlled.

If desired, burner 8, duct 10 and blower 11 could be disposed externally of dryer housing 4 with a duct connection through the housing wall to manifold 7.

The basic sources of air flowing into chamber 5 comprise the air from combustion blower 11, as well as air (arrows 13) which tends to infiltrate through the entrance and discharge web slots 14, 15 formed in housing 4. The air 13 tends to be pulled into chamber 5 because the latter is usually maintained at a slight negative pressure. In some instances, as in FIGS. 1 and 2, the uncontrolled infiltration of air 13 at slots 14, 15 is undesirable. Therefore, and in this embodiment, an air curtain is formed just interiorly of slots 14, 15 to reduce or minimize outside air infiltration into the drying chamber. As shown, the air curtains are formed by pairs of opposed elongated nozzles 16, 17 mounted on either side of the respective slots 14, 15. Air is supplied to nozzles 16, 17 as from manifold 7 and is directed to impinge on both sides of web 2. An air curtain could be formed at only one web slot if desired.

For purposes of keeping the temperature of the air within dryer chamber 5 relatively uniform, and for dryer nozzle air supply, a recirculation blower 18 is disposed therewithin and in the present embodiment is shown as connecting through the wall of plenum 9.

The air flowing into dryer housing 4 is ultimately discharged to the outside through an exhaust duct 19 and a variable air flow control device such as a variable speed exhaust blower 20. The mass of air flowing outwardly through exhaust duct 19 per unit of time is equivalent to the dryer ventilation rate which is the mass of air flowing through the dryer interior per unit of time.

As discussed heretofore, it is absolutely essential, that the dryer ventilation rate provides a vaporized ink solvent concentration in the air which is at least as low as 25% of the defined Lower Flammable Limit. For this purpose, a computerized ventilation rate control 21 is provided and which is adapted through modern chip technology to accept various inputs and derive an output which automatically drives a motorized device 21A which varies the exhaust flow. Ventilation rate control 21 is a microcomputer which may be implemented by a programmable controller such as that sold by Westinghouse under the name "Numa Logic", model PC 700.

FIG. 2 shows a device 21A which acts as a motor to variably operate exhaust blower 20. However, and as shown in phantom lines, device 21A may instead function as a motorized damper positioner which controls a different type of variable air flow control device such as a butterfly valve 20A.

In accordance with various aspects of the invention, control 21 is designed to receive information as to the rate of ink application to the traveling web. This may be determined in numerous ways.

Figure 3:
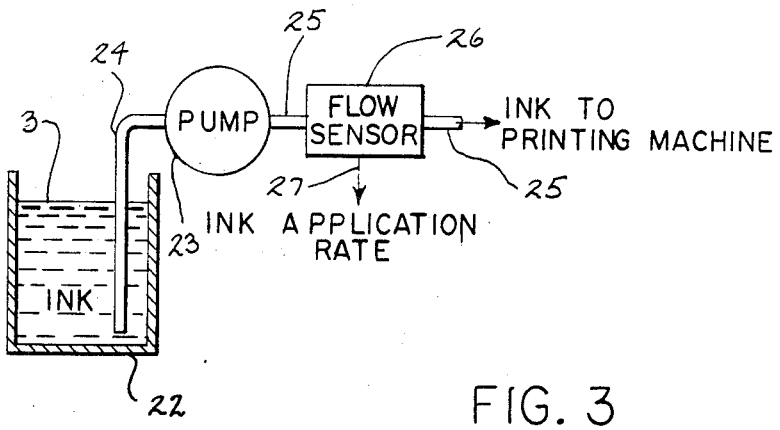
FIG. 3 is a schematic representation of determining the measured ink application rate.

FIG. 3 illustrates a system wherein the measured ink application rate is determined. One or more ink supplies, such as a single container 22 having a desired quantity of fluid ink 3 therein. A suitable pump 23 draws ink from container 22 through a conduit 24 and feeds it through a further conduit 25 to a device for applying ink 3 to web 2, such as a printing press, not shown. A fluid mass flow sensor 26 of any well-known type is disposed in conduit 25 and has an output responsive to the amount of ink flowing, and thus the mass of ink deposited on web 2. The sensor output connects through a line 27 to ventilation rate control 21. Elements 23–27 would be duplicated for each additional container 22, if multiple containers are used, in which case a suitable application rate totalizer would be included. Ink is comprised of several constituents including solvents which may vary in concentration and which must be taken into account. The typical solvent concentration for web offset heatset inks is about 40% of the total constituents.

Besides the information regarding the measured ink application rate, control 21 is also fed information as to the actual rate of mass flow of exhaust air through duct 19, which is the actual ventilation rate at a given moment. Referring to FIGS. 1 and 2, this is accomplished via a well-known mass flow transducer 28 having a probe 29 within duct 19 and an output connected through a line 30 to ventilation rate control 21.

Control 21 responds to the above-described input and its output is fed through a line 31 to motor 21A. Thus a control feedback loop is formed between exhaust duct 19 and its communicating exhaust blower 20.

The result is that, as the various above conditions vary, the speed of exhaust blower 20 is also caused to vary. A continuous maximum ventilation rate which exceeds the requirements is unnecessary. For example, the exhaust blower speed can be reduced if less ink is being applied.

Figure 4:
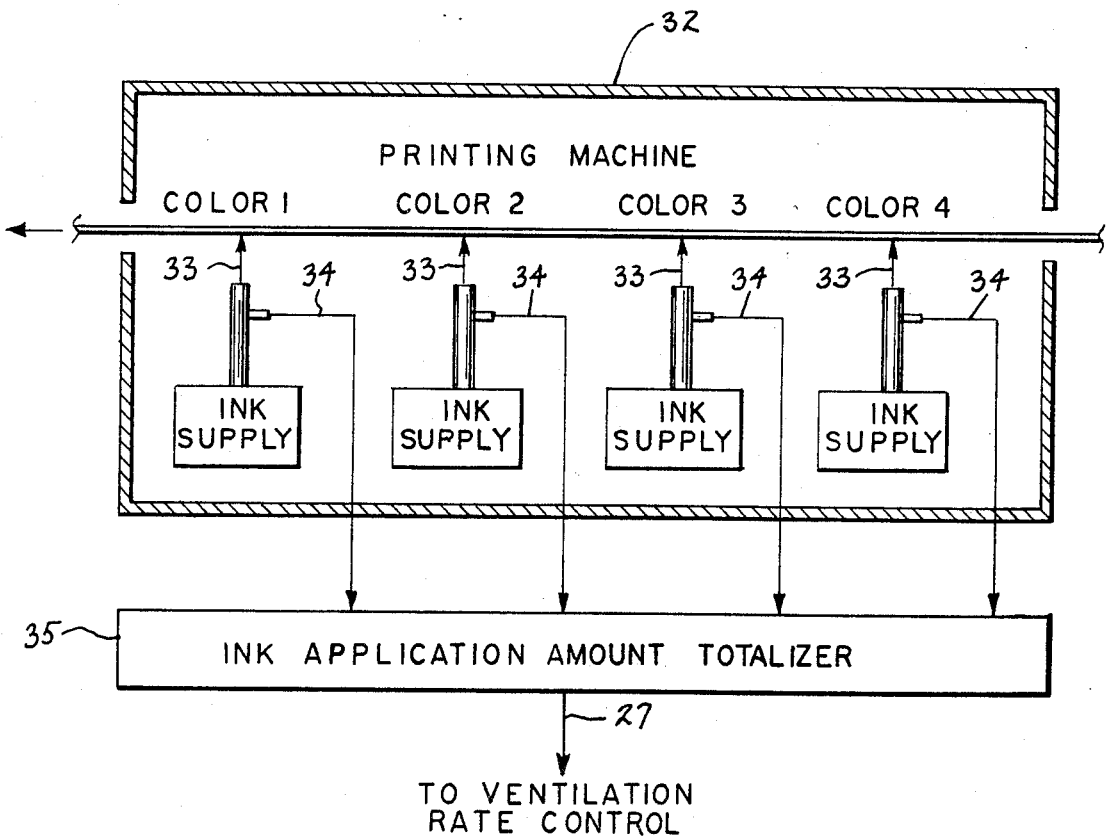
FIG. 4 is a schematic representation of an ink application sensing device used in determining the calculated ink application amount.

FIGS. 4–6 illustrates a different system wherein a calculated ink application rate is determined. Ink amount, web speed and width are measured to provide the desired output to ventilation rate control 21. As to ink amount, and as shown in the present embodiment, a printing machine 32 is adapted to print with a multiplicity of different colored inks, such as four. The web 2 is adapted to pass through four separate printing stations 33, each of which selectively applies one color in possibly varying amount. Sensors 34 of any suitable well-known type are disposed at each station 33 and are adapted to sense whether or not ink is being applied at that station at a particular time. The sensor outputs are fed to a computerized ink application amount totalizer 35 which can be set to provide a signal not only proportional to the number of colors being printed, but also in accordance with the maximum amount of each color which can be printed on the web at any given time, in accordance with industry standards. The output of totalizer 35 is then fed through line 27 to ventilation rate control 21.

The signal fed to control 21 must then be integrated with the web speed and width to provide a conservative calculated ink application rate. Thus two further inputs (shown in dash lines) must be added to control 21.

Referring to FIG. 5, web 2 passes through a nip 36 formed by a pair of rollers 37 mounted for rotation with drive or driven shafts 38 which rotate in accordance with the speed of web travel through the nip. A shaft encoder 39 of any well-known type is connected to read the rate of upper shaft rotation and feed the information through a line 40 to ventilation rate control 21. This information can of course be translated into a signal responsive to web speed.

Referring to FIGS. 1 and 6, a plurality of oppositely disposed photoelectric lights 41 and cells 42 are arrayed transversely across the longitudinally extending web 2. Depending upon the web width and its resultant blocking effect, all or only some of cells 42 receive signals from lights 41. The sum of the cell output signals is calculated at 43 and the ultimate web width calculation is fed through a line 44 to ventilation rate control 21, which then functions in the previously described manner. In this instance, for example, the exhaust blower speed can be reduced if the web speed, web width and/or ink amount applied is reduced.

In view of the variability of air flow through the dryer, the air supply to the dryer cannot be a constant if the "box" pressure is to be maintained at a desired constant level to prevent web flutter and other undesirable phenomenon. Therefore, and accompanying the variation in ventilation rate, auxiliary make-up air is supplied to the dryer from a suitable source.

The manner in which the make-up air is supplied is dependent on whether or not the infiltration air through web slots 14 and 15 is reduced. Such reduction of infiltration is contemplated in the embodiments of FIGS. 1, 2, 7A, 7B and 8.

In the embodiment of FIGS. 1 and 2, a restrictive make-up air inlet duct 45 is disposed in the wall of dryer housing 4. A probe 46 is disposed within chamber 5 for measuring the pressure therewithin and connects to a pressure transducer 47 of any suitable well-known type which in turn connects through a line 48 so that its output feeds to a box pressure control 49 which may be of any suitable well-known type. The output of control 49 is fed through a line 50 to a motorized damper positioner 51 which in turn is connected to position a butterfly valve 52 disposed in make-up air inlet duct 45. As shown, a constant speed blower 53 feeds external air through duct 45 with the resultant discharge into chamber 5 being dependent on the controlled position of valve 52.

FIG. 7A shows a somewhat similar concept utilizing a similarly controlled valved make-up air inlet duct, except air is supplied by induction rather than by a blower.

FIG. 7B illustrates an embodiment wherein instead of utilizing a valved inlet duct, box pressure control 49 feeds through a line 54 to a variable speed blower 55.

In the embodiment of FIGS. 1, 2, 7A and 7B, a control feedback loop is formed between dryer chamber 5 and its communicating make-up air inlet duct 45.

In some instances, this second feedback loop may not be absolutely necessary, with duct 45 being unvalved and no blower present. In such instance, there would be no positive control of the amount of make-up air, which would then merely be dependent on induction forces from within chamber 5.

Turning now to FIG. 8, the make-up air is variably provided through a feedback loop involving the combustion burner 8 instead of through a separate make-up air duct. For this purpose, the output of box pressure control 49 is fed through a line 56 to a motorized damper positioner 57 which in turn is connected to position butterfly valve 12 disposed in heating duct 10, which in turn is connected to constant speed blower 11.

It is to be noted that in the above-described embodiments, the make-up air is discharged into dryer chamber 5 at a point remote from exhaust duct 19 and, as shown, on the opposite side of web 2. The incoming make-up air, which may be cooler than the heated air, will thus be forced intimately to mix with the heated air recirculated within the dryer by blower 18 so that the temperature within the dryer is maintained generally uniform throughout. The result is that undesirable solvent condensation due to cool interior surface temperatures is substantially reduced or eliminated.

In the event that infiltration of air through web slots 14 and 15 is not to be reduced, an embodiment such as that shown in FIG. 9 is contemplated. In this instance, at least one of slots 14, 15, and preferably both, are provided with means to preheat the air being drawn thereinto. As shown, the air preheating means comprises a transversely elongated tunnel 58 which extends parallel to nozzles 6 and approximately along the full width of web 2 and through which the web passes. Tunnels 58 are disposed externally of slots 14, 15 and comprise opposed electric heating coils or plates 59 supplied through lines 60 from any suitable power source and which may be provided with insulated backings 61. Plates 59 serve to preheat the air entering the confined tunnels before it enters dryer chamber 5 as make-up air; at which time it is recirculated by blower 18 for temperature stabilization and uniformity as previously described.

While the description has been directed to flammable solvent based coatings, the concepts of the invention could also be applied to adjust solvent humidity to optimize drying requirements when flammability is not a problem, as by water-based coatings, without departing from the inventive spirit.

Furthermore, the functions of box pressure control 49 and ventilation rate control 21 as well as totalizer 35 may be performed by the same microcomputer if desired.

Various modes of carrying out the invention are contemplated as being within the scope of the following claims particularly pointing out and distinctly claiming the subject matter which is regarded as to the invention.

We claim:

1. The method of drying a continuously traveling web of paper or the like having ink or the like applied thereon, comprising the steps of:

(a) driving said web through a generally enclosed dryer housing forming a dryer chamber therein and wherein said housing has web slots therein, (b) providing heated drying air through an inlet duct into said chamber, (c) discharging exhaust air from said chamber through a variable air flow control device associated with an exhaust duct communicating with said chamber, () discharging heated air onto said web within said chamber prior to air discharge through said air flow control device, (e) determining the rate of application of ink to the said traveling web by sensing the number of flowing ink supplies feeding onto said web and calculating the amount of ink supplied, (f) and varying the flow of exhaust air in response to the information obtained from said determining step.

2. The method of claim 1 which includes the steps of:

(a) sensing the speed of travel of said web through the said dryer, (b) sensing the width of said web, (c) and further varying the flow of exhaust air in response to the information obtained from said speed and width sensing steps.

3. The method of claim 1 which includes the step of providing a supply of auxiliary air to said dryer housing chamber to maintain the pressure therewithin generally constant.

4. The method of claim 3 which includes the step of reducing infiltration of air through said web slots into said dryer housing chamber.

5. The method of claim 3 which includes the step of recirculating air within said dryer housing chamber to thereby mix said auxiliary air with the other air within said chamber.

6. The method of claim 3:

(a) wherein at least some auxiliary air is supplied to said dryer housing chamber by passing inwardly through the said slots, (b) and which includes the step of preheating said auxiliary air before it passes through the said slots.

7. A web dryer for drying a continuously traveling web of paper or the like having ink or the like applied thereon, comprising, in combination:

(a) a generally enclosed dryer housing forming a web drying chamber and with said housing having entrance and discharge web slots through which the web is adapted to pass, (b) air inlet and exhaust ducts connected to said chamber, (c) air heating means associated with said air inlet duct, (d) a variable air flow control device associated with said air exhaust duct, (e) nozzle means disposed within said chamber for discharging said heated air onto said web before said heated air is discharged through said exhaust duct, (f) the mass flow of air through said exhaust duct being equivalent to and providing a measure of the ventilation rate of air passing through said drying chamber, (g) first means to sense the speed of travel of said web through said dryer, (h) second means to sense the width of said traveling web, (i) third means to determine the amount of ink applied to said traveling web, (j) fourth means to sense the mass of air flow through said exhaust duct, (k) first control means responsive to said first, second, third and fourth means to control the operation of said variable air flow control device, (l) said first control means forming a feed back loop connecting said exhaust duct with said variable air flow control device, (m) and second control means responsive to pressure within said dryer housing chamber for assisting in providing auxiliary make-up air to said chamber, (n) said second control means forming a second feed back loop associated with said dryer housing chamber.

8. A web dryer for drying a continuously traveling web of paper or the like having ink or the like applied thereon, comprising, in combination:

(a) a generally enclosed dryer housing forming a web drying chamber and with said housing having entrance and discharge web slots through which the web is adapted to pass, (b) air inlet and exhaust ducts connected to said chamber, (c) air heating means associated with said air inlet duct, (d) a variable air flow control device associated with said air exhaust duct, (e) nozzle means disposed within said chamber for discharging said heated air onto said web before said heated air is discharged through said exhaust duct, (f) the mass flow of air through said exhaust duct being generally equivalent to and providing a measure of the ventilation rate of air passing through said drying chamber, (g) means to determine the rate of application of ink to said traveling web, (h) control means responsive to said ink application rate determining means to control the operation of said variable air flow control device, (i) said control means forming a feedback loop connecting said exhaust duct with said variable air flow control device, (j) auxiliary air supplying means to provide make-up air to the said chamber of said dryer to maintain the pressure therewithin generally constant during operation of said control means, said auxiliary air supplying means including:

(1) said first-named air inlet duct with which is associated said air heating means, (2) a second air inlet blower connected to said first-named air inlet duct, (3) valve means to restrictively vary the flow of air within said first-named air inlet duct, (4) and second control means responsive to the pressure within said dryer housing chamber to varingly actuate said valve means.

9. The web dryer of claim 8 wherein said second control means comprises a feedback loop connecting said dryer housing chamber with said valve means.

10. The web dryer of claim 8 in which said first-named air inlet duct is disposed for discharge of air into said housing chamber at a position remote from said exhaust duct.

11. The web dryer of claim 10 which includes means for recirculating air within said dryer housing chamber to mix air entering through said first-named air inlet duct with other air within said chamber.

12. A web dryer for drying a continuously traveling web of paper or the like having ink or the like applied thereon, comprising, in combination:

(a) a generally enclosed dryer housing forming a web drying chamber and with said housing having entrance and discharge web slots through which the web is adapted to pass, (b) air inlet and exhaust ducts connected to said chamber, (c) air heating means associated with said air inlet duct, (d) a variable air flow control device associated with said air exhaust duct, (e) nozzle means disposed within said chamber for discharging said heating air onto said web before said heated air is discharged through said exhaust duct, (f) the mass flow of air through said exhaust duct being generally equivalent to and providing a measure of the ventilation rate of air passing through said drying chamber, (g) means to determine the rate of application of ink to said traveling web, (h) control means responsive to said ink application rate determining means to control the operation of said variable air flow control device, (i) said control means forming a feedback loop connecting said exhaust duct with said variable air flow control device, (j) auxiliary air supplying means to provide make-up air to the said chamber of said dryer to maintain the pressure therewithin generally constant during operation of said control means, (k) means for controllably reducing the infiltration of air into said housing chamber through said slots, (l) said auxiliary air supplying means comprising a restrictive second air inlet duct connected to said chamber, (m) valve means disposed to restrictively vary the flow of air within said second duct, (n) and second control means responsive to the pressure within said dryer housing chamber to varyingly actuate said valve means.

13. The web dryer of claim 12 wherein said second control means comprises a feedback loop connecting said dryer housing chamber with said valve means.

14. A web dryer for drying a continuously traveling web of paper or the like having ink or the like applied thereon, comprising, in combination:

(a) a generally enclosed dryer housing forming a web drying chamber and with said housing having entrance and discharge web slots through which the web is adapted to pass, (b) air inlet and exhaust ducts connected to said chamber, (c) air heating means associated with said air inlet duct, (d) a variable air flow control device associated with said air exhaust duct, (e) nozzle means disposed within said chamber for discharging said heated air onto said web before said heated air is discharged through said exhaust duct, (f) the mass flow of air through said exhaust duct being generally equivalent to and providing a measure of the ventilation rate of air passing through said drying chamber, (g) means to determine the rate of application of ink to said traveling web, (h) control means responsive to said ink application rate determining means to control the operation of said variable air flow control device, (i) said control means forming a feedback loop connecting said exhaust duct with said variable air flow control device, (j) auxiliary air supplying means to provide make-up air to the said chamber of said dryer to maintain the pressure therewithin generally constant during operation of said control means, (k) means for controllably reducing the infiltration of air into said housing chamber through said slots, (l) said auxiliary air supplying means comprising a restrictive second air inlet duct connected to said chamber, (m) a variable speed inlet blower connected to said second duct, (n) and second control means responsive to the pressure within said dryer housing chamber to vary the speed of said last-named blower.

15. The web dryer of claim 14 wherein said second control means comprises a feedback loop connecting said dryer housing chamber with said last-named blower.

16. The web dryer of claim 12 or 14 in which said second air inlet duct is disposed for discharge of air into said housing chamber at a position remote from said exhaust duct.

17. The web dryer of claim 16 which includes means for recirculating air within said dryer housing chamber to mix air entering through said second air inlet duct with other air within said chamber.

18. A web dryer for drying a continuously traveling web of paper or the like having ink or the like applied thereon, comprising, in combination:

(a) a generally enclosed dryer housing forming a web drying chamber and with said housing having entrance and discharge web slots through which the web is adapted to pass, (b) air inlet and exhaust ducts connected to said chamber, (c) air heating means associated with said air inlet duct, (d) a variable air flow control device associated with said air exhaust duct, (e) nozzle means disposed within said chamber for discharging said heated air onto said web before said heated air is discharged through said exhaust duct, (f) the mass flow of air through said exhaust duct being generally equivalent to and providing a measure of the ventilation rate of air passing through said drying chamber, (g) means to determine the rate of application of ink to said traveling web, (h) control means responsive to said ink application rate determining means to control the operation of said variable air flow control device, (i) said control means forming a feedback loop connecting said exhaust duct with said variable air flow control device, (j) said rate determining means including means for calculating the amount of ink being applied to said traveling web.

19. The web dryer of claim 18 in which said calculating means includes: means for sensing the number of flowing ink supplies feeding onto said web and for calculating the amount of ink supplied.

20. The web dryer of claim 18 in which said calculating means comprises:

(a) means for sensing the number of flowing ink supplies feeding onto said web and for calculating the amount of ink supplied, (b) and means connecting said last-named means to said variable air flow control device.

21. The web dryer of claim 19 or 20 which includes:

(a) speed sensing means to sense the speed of travel of said web through said dryer, (b) and width sensing means to sense the width of said traveling web.

22. The web dryer of claim 21 which includes means connecting said speed sensing means and said width sensing means to said variable air flow control device.

23. The method of drying a continuously traveling web of paper or the like having ink or the like applied thereon, comprising the steps of:

(a) driving said web through a generally enclosed dryer housing forming a dryer chamber therein and wherein said housing has web slots therein, (b) providing heated drying air through an inlet duct into said chamber, (c) discharging exhaust air from said chamber through a variable air flow control device associated with an exhaust duct communicating with said chamber, (d) discharging heated air onto said web within said chamber prior to air discharge through said air flow control device, (e) sensing the speed of travel of said web through said dryer, (f) sensing the width of said traveling web, (g) determining the amount of ink applied to said traveling web, (h) sensing the mass of air flow through the exhaust duct, (i) and varying the flow of exhaust air in response to the information obtained from said steps (e) through (h).

24. The method of claim 23 which includes the step of providing a supply of auxiliary air to said dryer housing chamber to maintain the pressure therewithin generally constant.

25. The method of claim 24 which includes the step of reducing infiltration of air through said web slots into said dryer housing chamber.

26. The method of claim 24 which includes the step of recirculating air within said dryer housing chamber to thereby mix said auxiliary air with the other air within said chamber.

27. The method of claim 24:

(a) wherein at least some auxiliary air is supplied to said dryer housing chamber by passing inwardly through the said slots, (b) and which includes the step of preheating said auxiliary air before it passes through the said slots.

28. A web dryer for drying a continously traveling web of paper or the like having ink or the like applied thereon, comprising, in combination:

(a) a generally enclosed dryer housing forming a web drying chamber and with said housing having entrance and discharge web slots through which the web is adapted to pass, (b) air inlet and exhaust ducts connected to said chamber, (c) air heating means associated with said air inlet duct, (d) a variable air flow control device associated with said air exhaust duct, (e) nozzle means disposed within said chamber for discharging said heated air onto said web before said heated air is discharged through said exhaust duct, (f) the mass flow of air through said exhaust duct being generally equivalent to and providing a measure of the ventilation rate of air passing through said drying chamber, (g) first means to sense the speed of travel of said web through said dryer, (h) second means to sense the width of said traveling web, (i) third means to determine the amount of ink applied to said traveling web, (j) fourth means to sense the mass of air flow through said exhaust duct, (k) and control means responsive to said first, second, third and fourth means to control the operation of said variable air flow control device.

29. The web dryer of claim 28 wherein said control means forms a feed back loop connecting said exhaust duct with said variable air flow control device.

30. The web dryer of claim 28 in which said first means comprises:

(a) a rotatable means through which said traveling web passes, (b) and encoder means responsive to the rotation of said rotatable means and having an output connected to said control means.

31. The web dryer of claim 28 in which said second means comprises photoelectric means disposed adjacent said traveling web and having an output connected to said control means.

32. The web dryer of claim 28 in which said third means comprises:

(a) source means for fluid ink, (b) and means connected to said source means for supplying fluid ink to an ink applying device, (c) said ink usage determining means being associated with said source means and having an output means connected to said control means.

33. The web dryer of claim 28 in which said fourth means comprises:

transducer means connected within said exhaust duct and having an output connected to said control means for sensing mass flow.

34. The web dryer of claim 28 in which:

(a) said first means comprises:

(1) rotatable means through which said traveling web passes, (2) and encoder means responsive to the rotation of said rotatable means and having an output connected to said control means;

(b) said second means comprises:

photoelectric means disposed adjacent said traveling web and having an output connected to said control means;

(c) said third means comprises:

(1) source means for fluid ink, (2) and means connected to said source means for supplying fluid ink to an ink applying device, (3) said ink usage determining means being associated with said source means and having output means connected to said control means;

(d) and said fourth means comprises:

transducer means connected within said exhaust duct and having an output connected to said control means for sensing mass flow.

35. The web dryer of claim 28 which includes auxiliary air supplying means to provide make-up air to the said chamber of said dryer to maintain the pressure therewithin generally constant during operation of said control means.

36. The web dryer of claim 35 which includes means for controllably reducing the infiltration of air into said housing chamber through said slots.

37. The web dryer of claim 36 wherein said infiltration reducing means comprises air curtain forming means disposed inwardly and closely adjacent at least one of said web slots to direct air into opposed impingement with said traveling web.

38. The web dryer of claim 36 wherein said auxiliary air supplying means comprises a restrictive second air inlet duct connected to said chamber.

39. The web dryer of claim 38 which includes:

(a) an inlet blower connected to said second duct, (b) valve means disposed to restrictively vary the flow of air within said second duct, (c) and second control means responsive to the pressure within said dryer housing chamber to varyingly actuate said valve means.

40. The web dryer of claim 38 which includes:

(a) valve means disposed to restrictively vary the flow of air within said second duct, (b) and second control means responsive to the pressure within said dryer housing chamber to varyingly actuate said valve means.

41. The web dryer of claim 39 or 40 wherein said second control means comprises a feedback loop connecting said dryer housing chamber with said valve means.

42. The web dryer of claim 38 which includes:

(a) a variable speed inlet blower connected to said second duct, (b) and second control means responsive to the pressure within said dryer housing chamber to vary the speed of said last-named blower.

43. The web dryer of claim 42 wherein said second control means comprises a feedback loop connecting said dryer housing chamber with said last-named blower.

44. The web dryer of claim 36 wherein said auxiliary air supplying means includes:

(a) said first-named air inlet duct with which is associated said air heating means, (b) a second air inlet blower connected to said first-named air inlet duct, (c) valve means to restrictively vary the flow of air within said first-named air inlet duct, (d) and second control means responsive to the pressure within said dryer housing chamber to varyingly actuate said valve means.

45. The web dryer of claim 44 wherein said second control means comprises a feedback loop connecting said dryer housing chamber with said valve means.

46. The web dryer of claim 38, 39, 40 or 42 in which said second air inlet duct is disposed for discharge of air into said housing chamber at a position remote from said exhaust duct.

47. The web dryer of claim 46 which includes means for recirculating air within said dryer housing chamber to mix air entering through said second air inlet duct with other air within said chamber.

48. The web dryer of claim 44 in which said first-named air inlet duct is disposed for discharge of air into said housing chamber at a position remote from said exhaust duct.

49. The web dryer of claim 48 which includes means for recirculating air within said dryer housing chamber to mix air entering through said first-named air inlet duct with other air within said chamber.

50. The web dryer of claim 35: wherein air infiltrates through said web slots into said dryer housing chamber by induction, thereby providing said auxiliary air supplying means.

51. The web dryer of claim 50 which includes means disposed externally of and adjacent at least one of said slots to preheat the air passing inwardly therethrough.

52. The web dryer of claim 51 in which said air preheating means comprises an elongated heated tunnel extending transversely of the traveling web and approximately along the full web width.

53. A web dryer for drying a continously traveling web of paper or the like having ink or the like applied thereon, comprising, in combination:

(a) a generally enclosed dryer housing forming a web drying chamber and with said housing having entrance and discharge web slots through which the web is adapted to pass, (b) air inlet and exhaust ducts connected to said chamber, (c) air heating means associated with said air inlet duct, (d) a variable air flow control device associated with said air exhaust duct, (e) nozzle means disposed within said chamber for discharging said heated air onto said web before said heated air is discharged through said exhaust duct, (f) the mass flow of air through said exhaust duct being generally equivalent to and providing a measure of the ventilation rate of air passing through said drying chamber, (g) means to determine the rate of application of ink to said traveling web, (h) first control means responsive to said ink application rate determining means to control the operation of said variable air flow control device, (i) said first control means forming a feed back loop connecting said exhaust duct with said variable air flow control device, (j) and second control means responsive to pressure within said dryer housing chamber for assisting in providing auxiliary make-up air to said chamber, (k) said second control means forming a second feed back loop associated with said dryer housing chamber.

54. The method of drying a continuously traveling web of paper or the like having ink or the like applied thereon, comprising the steps of:

(a) driving said web through a generally enclosed dryer housing forming a dryer chamber therein and wherein said housing has web slots therein, (b) providing heated drying air through an inlet duct into said chamber, (c) discharging air from said chamber through a variable air flow control device associated with an exhaust duct communicating with said chamber, (d) discharging heated air onto said web within said chamber prior to air discharge through said air flow control device, (e) sensing the speed of travel of said web through said dryer, (f) sensing the width of said traveling web, (g) determining the amount of ink applied to said traveling web, (h) sensing the mass of air flow through the exhaust duct, (i) varying the flow of exhaust air in response to the information obtained from said steps (e) through (h), (j) providing a supply of auxiliary air to said dryer housing chamber to maintain the pressure therewithin generally constant, (k) reducing infiltration of air through said web slots into said dryer housing chamber, (l) recirculating air within said dryer housing chamber to thereby mix said auxiliary air with the other air within said chamber, (m) at least some auxiliary air being supplied to said dryer housing chamber by passing inwardly through the said slots, (n) and preheating said auxiliary air before it passes through the said slots.

* * * * *

UNITED STATES PATENT AND TRADEMARK OFFICE

CERTIFICATE OF CORRECTION

PATENT NO. : 4,591,517

DATED : May 27, 1986

INVENTOR(S) : RODGER E. WHIPPLE ET AL

It is certified that error appears in the above-identified patent and that said Letters Patent is hereby corrected as shown below:

In Claim 1, column 8, line 1, delete "0" and insert --(d)--

In Claim 12, column 10, line 10, delete "heating" and insert --heated--

Signed and Sealed this

Twenty-third Day of September 1986

[SEAL]

Attest:

DONALD J. QUIGG

Attesting Officer

Commissioner of Patents and Trademarks